United States Patent [19]

Suttles

[11] 4,201,139

[45] May 6, 1980

[54] SHELVING SYSTEM

[75] Inventor: James M. Suttles, Elberton, Ga.

[73] Assignee: The Mead Corporation, Atlanta, Ga.

[21] Appl. No.: 3,498

[22] Filed: Jan. 15, 1979

[51] Int. Cl.[2] ..... A47B 57/24

[52] U.S. Cl. ..... 108/109; 248/243

[58] Field of Search ..... 108/109, 111, 114; 248/243

[56] References Cited

U.S. PATENT DOCUMENTS

| | | | |
|---|---|---|---|
| 2,990,067 | 6/1961 | Bartlett | 248/243 X |
| 3,227,110 | 1/1966 | Hamilton | 108/111 |
| 3,244,127 | 4/1966 | Evans | 108/111 |
| 4,101,108 | 7/1978 | Klein | 108/114 X |

FOREIGN PATENT DOCUMENTS

| | | | |
|---|---|---|---|
| 774697 | 5/1957 | United Kingdom | 108/109 |

*Primary Examiner*—Francis K. Zugel

*Attorney, Agent, or Firm*—George A. Smith, Jr.

[57] ABSTRACT

In a sheet metal shelving system, shelf clips for retaining shelves on support posts are provided with hooks for engaging openings in the support posts and also with projections which enter openings and prevent removal of the clips from the posts. The projection is held in place in its opening by reason of the engagement of a shelf apron in the retaining portion of the clip. The apron is held in the retaining portion of the clip by a snap-fit relationship between a rolled lower edge of the apron and one or more projections formed in the retaining portion of the clip.

2 Claims, 5 Drawing Figures

SHELVING SYSTEM

BRIEF SUMMARY OF THE INVENTION

This invention relates to systems of shelving of the type used in supermarkets for the display and merchandising of soft drink bottles. The invention relates in particular to novel means for securing shelves to upright support posts.

Within the past several years, a great deal of design effort has been devoted to soft drink display shelving for supermarket use. For the most part, soft drink display stands are sheet metal assemblies which are shipped to the supermarket in knocked-down form for assembly by supermarket personnel. In order to simplify assembly, much of the design effort has been directed toward reducing the number of parts, making various parts interchangeable, and providing flexibility in the number and spacing of the shelves in a particular display stand.

One popular form of display stand comprises a rectangular base having shelf-support posts extending vertically upward from its corners. The posts are provided with a vertically aligned series of openings into which shelf-supporting clips can be hooked. The shelves are, in turn, supported by the clips.

The use of shelf-supporting clips on vertical posts having vertically-extending arrays of openings provides the user with a high degree of flexibility, in that he can readily install shelves in desired positions on the support posts to accommodate various sizes of soft drink bottles. The system of clips and support posts also permits the user to move the shelves readily to new positions for a more efficient use of the available shelf space.

One of the problems encountered in the use of display shelving of the type utilizing support posts and shelf-supporting clips is that the shelves and the clips themselves are held in place only by gravity. Consequently, when the assembled display stand is tilted on its side, which is occasionally necessary when it is to be moved through a doorway, or moved to another location in the store, the shelves separate from the clips, and the clips fall out of the upright supports, necessitating reassembly. The principal object of this invention is to prevent separation of the shelves from the clips and of the clips from the uprights, and to do so without requiring additional fasteners or other parts, and without impairing the flexibility of the shelving system.

In order to achieve the foregoing objective, I use a specially designed clip. My new clip has a hook, and a shelf-retaining structure similar to those of the conventional clip. The new clip differs from the conventional clip in that it is also provided with means responsive to the presence of a shelf on its shelf-retaining means for preventing removal of the hook from the upright opening through which the hook extends. The new clip also differs from the conventional clip in that it includes snap-fit means for removably securing the shelf against upward vertical movement away from the clip. Where the new clip is used, the entire assembly can be tilted on its side without having the shelves fall away from the clips, and without having the clips fall away from the uprights.

In its preferred form, the clip is provided with a projection located below the hook, and positioned so that it enters an opening in the upright below the opening which receives the hook. The projection is held in its corresponding opening in the upright by virtue of the presence of a shelf apron between the upright post and the shelf-retaining means on the clip. Preferably, the shelf apron is provided with a rolled lower edge projecting in a direction away from the post and cooperating with one or more projections on the retainer portion of the clip to secure the shelf against upward movement away from the clip. The rolled lower edge of the apron serves two functions in that it causes the clip to pivot about the hook so that the projection below the hook enters an opening in the post and remains in the opening, and in that it cooperates with the projection or projections on the shelf-retaining portion of the clip to hold the shelf itself in place.

Desirably, the projection below the hook on the clip is positioned so that it rests on the lower edge of the post opening through which it extends. Consequently, the load on the shelf is supported not only by the hook, but also by the projection. The upper surface of the projection, and the upper edge of its corresponding opening in the post are desirably perpendicular to the post in order to eliminate any possibility of a camming action which might cause the clip to become disengaged from the post.

Various other objects, advantages and details of the invention will be apparent from the following detailed description when read in conjunction with the drawings.

DETAILED DESCRIPTION

Figure 1:
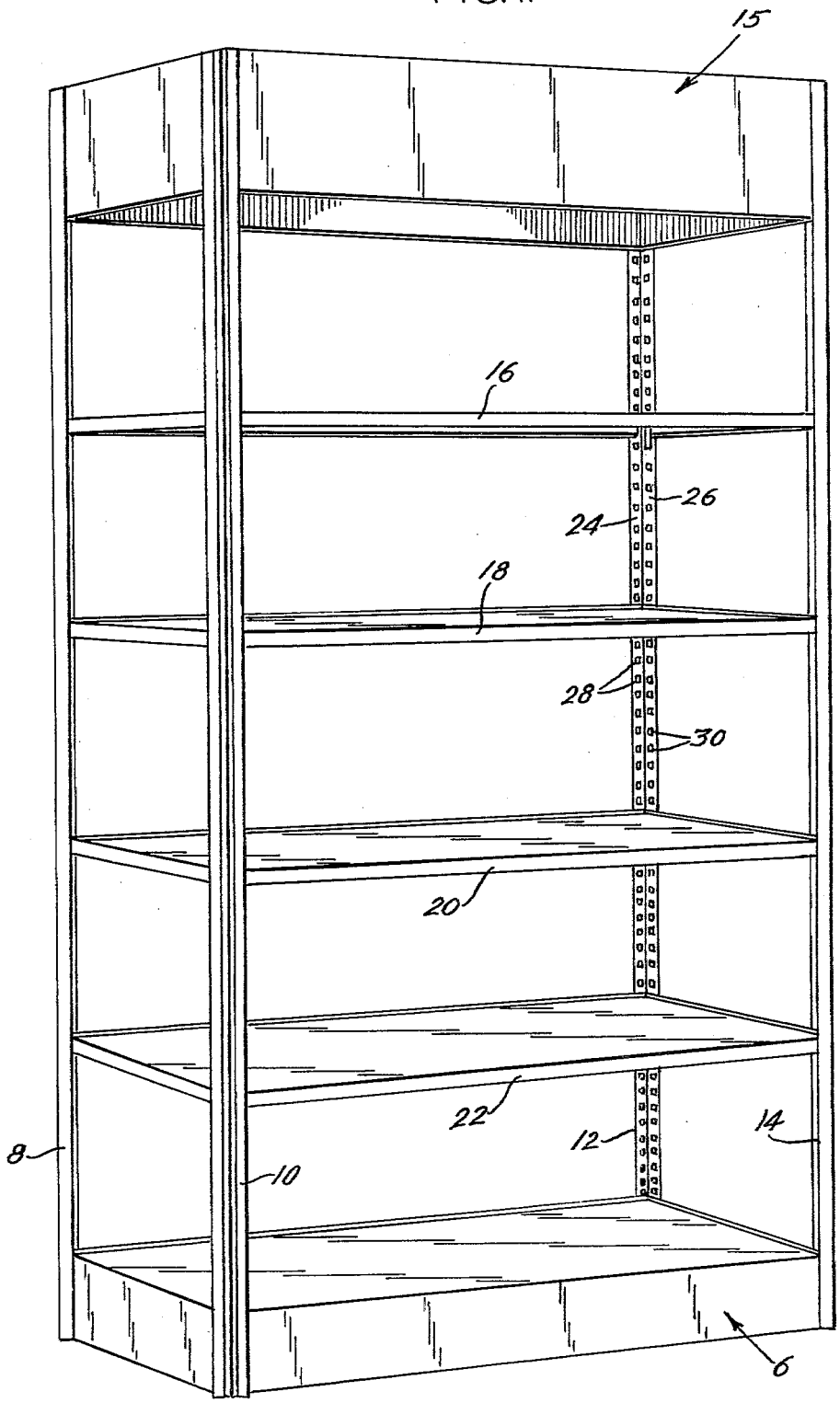
FIG. 1 is a perspective view of a typical four-post display shelf in accordance with the invention.

FIG. 1 shows a typical four-post beverage display stand in accordance with the invention having a generally rectangular base 6, upright posts 8, 10, 12 and 14 extending upwardly from the four corners of the base, a top assembly 15, and a series of horizontally disposed rectangular shelves 16, 18, 20 and 22. As illustrated by post 12 in FIG. 1, each post comprises a pair of mutually perpendicular front surfaces 24 and 26. Front surface 24 has a series of uniformly spaced openings 28, and front surface 26 has a similar series of uniformly spaced openings 30.

Figure 5:
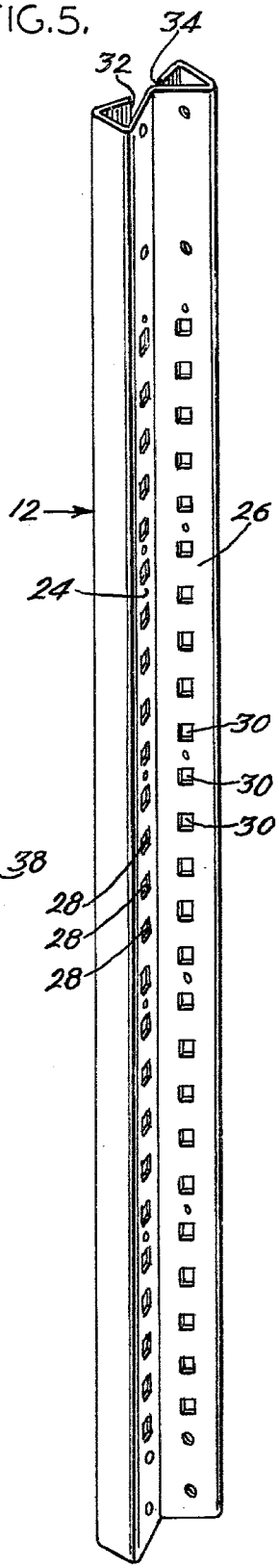
FIG. 5 is a perspective view showing the details of an upright post.

As shown in FIG. 5, post 12 is formed by bending a rectangular elongated flat sheet of metal having long edges 32 and 34 so that the horizontal cross-section is generally in the form of a W, with surfaces 24 and 26 perpendicular to each other. Openings 28 and 30 are preferably rectangular, and preferably extend entirely through the sheet metal to the rear surfaces corresponding to front surfaces 24 and 26. In the conventional four-post shelving system, these rectangular openings receive hooks of the shelf-support clips. Screw holes are provided in the post for attachment of the post to the various members of the base and top assemblies. Alternatively, the base and top assemblies can be secured to the posts by suitable interengaging tabs and slots in order to eliminate the need for screws or other separate fasteners.

Figure 3:
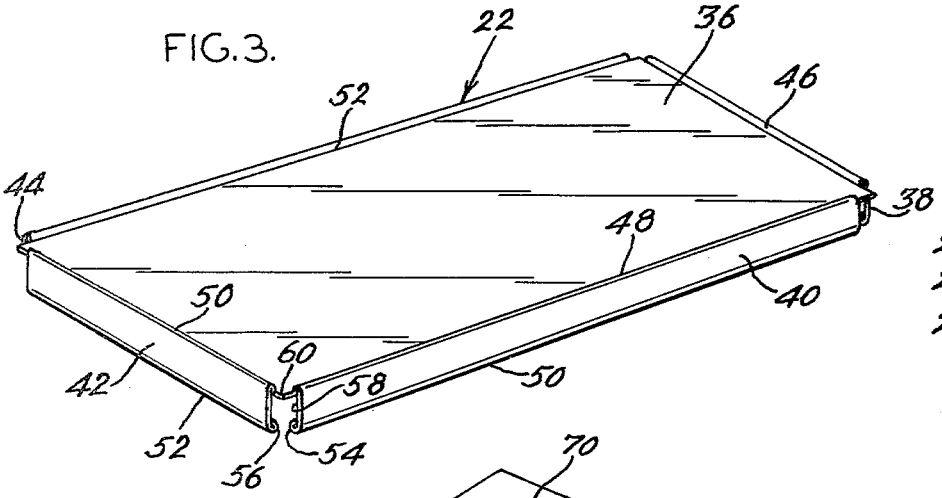
FIG. 3 is a perspective view of a typical shelf in accordance with the invention.

As shown in FIG. 3, shelf 22 is formed from a single piece of sheet metal, and comprises a generally rectangular, flat, article-supporting surface 36 having integral, depending aprons 38, 40, 42 and 44 extending along its edges. The aprons are preferably formed in such a way as to provide upwardly extending rims 46, 48, 50 and 52 along the edges of supporting surface 36. From the upwardly extending rims, the aprons extend downwardly in a direction generally perpendicular to supporting surface 36, and terminate in rolled edges exemplified by edge 50 of apron 40 and edge 52 of apron 42. These rolled edges are located below supporting surface 36, and extend in directions parallel to the supporting surface. The rolled lower edges project inwardly, as indicated at 54 and 56. The vertical edges of the aprons (e.g. edge 58 of apron 40) are spaced a short distance from the corners of surface 36 (e.g. corner 60) in order to prevent interference between the inwardly projecting rolls at the lower edges of the aprons.

Figure 4:
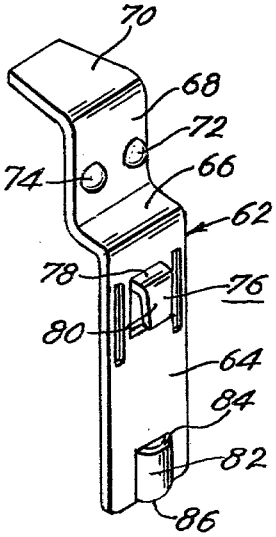
FIG. 4 is a perspective view of the clip.

As shown in FIG. 4, clip 62 is formed from a single piece of heavy-gauge sheet metal. Clip 62 comprises a first vertical section 64, a first horizontal section 66 extending in a direction perpendicular to the upper edge of section 64, a second vertical section 68 extending upwardly from horizontal section 66, and a second horizontal section 70 extending horizontally from the upper edge of vertical section 68. As seen in FIG. 4, vertical sections 68 and 64 are spaced from each other by a short horizontal distance corresponding to the length of horizontal section 66, and section 70 extends horizontally in a direction away from section 64. Section 68 acts as a shelf-retainer, and a pair of rounded projections 72 and 74 are provided on section 68, and project horizontally in a direction toward section 64. A hook 76 is stamped out of section 64 near the upper end of that section. The hook comprises a horizontal portion 78 extending in the same direction as projections 72 and 74, and a depending vertical section 80 extending downwardly in a direction parallel to the surface of section 64.

At the lower end of section 64, a generally cylindrical projection 82 is stamped out, and projects in the same direction as does section 78 of hook 76. Projection 82 is cylindrical about a vertical axis, and has a horizontal upper surface 84. Preferably, the lower surface 86 of projection 82 is also horizontal.

The vertical extent of projection 82 is preferably just slightly less than the vertical extent of each of the rectangular openings in the posts. The horizontal extent of projection 82, in the plane of the surface of section 64 of the clip seen in FIG. 4, is preferably equal to or slightly greater than the horizontal extent of the openings in the post.

Surface 86 of projection 82, and the underside of section 78 of the hook are preferably spaced by a vertical distance equal to the vertical distance between the lower edges of the openings of any adjacent pair of openings in the post. With the spacing so chosen, both the hook and projection 82 provide bearing surfaces supporting the vertical load on the shelf.

Figure 2:
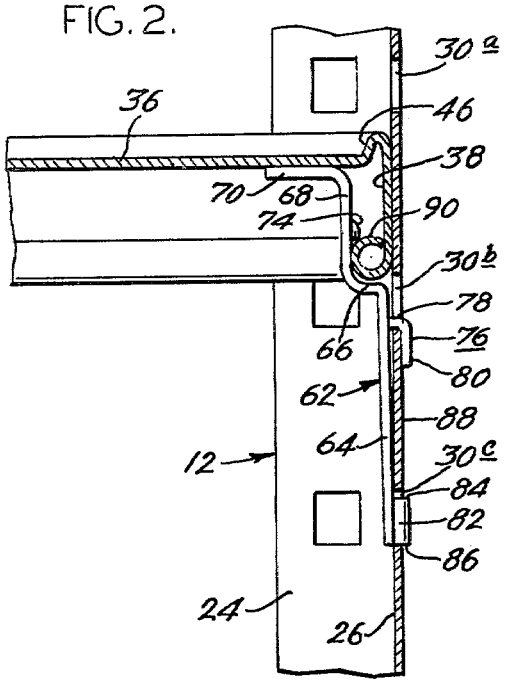
FIG. 2 is a fragmentary vertical section illustrating the manner in which the clip in accordance with the invention secures a corner of a shelf to an upright post.

Referring now to FIG. 2, a shelf having supporting surface 36 is shown supported on post 12 by clip 62. Clip 62 is located adjacent front surface 26 of post 12, and cooperates with openings 30*b* and 30*c*. Opening 30*b* receives hook 76 of the clip, with the underside of horizontal portion 78 of the hook resting on the lower edge of opening 30*b*, and with depending tab 80 of the hook engaging rear surface 88 of the post. Projection 82, below the hook, extends into opening 30*c*, and surface 86 rests on the lowermost edge of opening 30*c*.

It will be observed that the installation of the clip is simply a matter of engaging hook 76 in opening 30*b*. The clearance between tab 76 and section 64 of the clip should be slightly greater than the width of the sheet metal of the post, and such as to allow projection 82 to swing into and out of opening 30*c* about a pivot formed at the point at which horizontal section 78 of hook 76 engages the lower edge of opening 30*b*. Consequently, the clip can be readily installed and removed, so long as the shelf is not present. The cylindrical configuration of projection 82 insures its entry into opening 30*c* in the event of a slight misalignment.

With hook 76 engaged in opening 30*b*, the shelf is installed by pushing the rolled lower edge of apron 36 into the space between vertical section 68 of the clip and front surface 26 of the post. The shelf is pushed downwardly until inwardly projecting roll 90 at the lower edge of apron 38 passes over projection 74 (and also over projection 72, as shown in FIG. 4). The dimensions of roll 90 and projections 74 and 72, and their positions, are such as to permit roll 90 to be snapped into place with relatively little effort, but to prevent the shelf from falling out of engagement with the clip when the display stand is turned on its side. The underside of supporting surface 36 rests on clip section 70, and roll 90 remains spaced from clip section 66 by a short distance.

When the shelf is in position, with the underside of supporting surface 36 resting on horizontal clip section 70, roll 90 remains in tight engagement with projections 74 and 72. The engagement of the roll 90 of the shelf with the projections 72 and 74 on the shelf-retaining portion 68 of the clip prevents the shelf from vibrating or rattling. Also, by reason of the engagement of roll 90 with these projections, projection 82 at the lower end of clip 62 is urged into opening 30*c* of the post. So long as projection 82 is held in opening 30*c*, the clip cannot be removed from the post, as upward vertical movement of the clip would result in the engagement of flat upper surface 84 of projection 82 with the upper edge of opening 30*c*. Desirably, the vertical dimension of projection 82 is nearly equal to that of opening 30*c*, and upper surface 84 of the projection, and the upper edge of opening 30*c* are preferably perpendicular to front surface 26 to avoid the possibility of a camming action which would allow disengagement of the clip from the post upon upward movement of the clip.

From FIG. 2, it will be apparent that the insertion of shelf apron 38 into the shelf retainer comprising clip sections 66 and 68 causes the clip to rotate about the pivot at hook section 78 so that projection 82 enters opening 30*c*. The presence of the shelf in engagement with the shelf retainer insures that projection 82 remains in opening 30*c* to prevent disengagement of the clip from the post.

Disassembly of the system is accomplished by striking an upwardly directed blow on the underside of the shelf to disengage roll 90 from projections 74 and 72. The shelf is then lifted out, and the clips can be readily removed.

In a complete display stand such as the one shown in FIG. 1, four clips are used for each shelf, one clip being located at each corner of each shelf. The clip can be installed on either of the two mutually perpendicular surfaces of the post. Where extra strength is desired, two clips can be provided at each corner of a shelf.

It will be apparent that, with the system just described, display stands can be readily assembled and disassembled, and the positions of the shelves can be readily changed. At the same time, the display stand can be tilted on its side, or even turned upside down without coming apart. The utility of the invention is not limited to beverage display stands, as the features of the invention described herein can be used in various shelving systems, such as library shelves, and equipment storage shelves.

Various changes can be made to the clip, shelf and post configurations described herein without departing from the invention as defined in the following claims.

I claim:

1. A system of shelving comprising at least one shelf having a supporting surface, support means for holding said shelf in a fixed position above a floor, said support means having front and rear surfaces, and clip means located adjacent said front surface of said support means for securing said shelf to said support means, said support means having a first opening adapted to receive a hook, said first opening providing access from said front surface to the rear surface of said support means, and a second opening spaced from said first opening and adapted to receive a projection, said clip having a lower section, a hook extending from said lower section through said first opening, said hook having a depending tab engaging said rear surface, and said lower section also having a projection spaced from said hook in a direction such that said depending tab points toward said projection, said projection extending into said second opening, and said clip also having an upper section connected to said lower section by a horizontally extending clip section and offset from said lower section so that it is spaced from said front surface, and extending from said horizontally extending clip section in generally parallel relation to said front surface in a direction opposite to the direction in which said depending tab extends, said upper section having horizontally extending means at its upper end engaging the underside of said shelf and said shelf having apron means extending between said front surface and said upper section the space between said upper section and said front surface being such that, when said apron is located between said upper section and said front surface, said upper section is urged away from said front surface, and said projection is urged into said second opening whereby said hook cannot become disengaged from said first opening while said apron is in place between said upper section and said front surface of said support means and in which said apron means is provided with a rolled lower edge located below said supporting surface and above and spaced from said horizontally extending clip section, and projecting in the direction away from said front surface of the support means and in which said upper section is provided with rounded projecting means projecting toward said front surface, said rolled edge and said rounded projecting means being in engagement with each other, with at least part of said rolled edge being located below at least part of said rounded projecting means whereby said shelf is removably secured against upward vertical movement away from said clip means.

2. A system according to claim 1 in which the space between the upper section of the clip and the front surface of the support means is substantially equal to the width of the rolled lower edge of the apron whereby said projection is maintained in said second opening as a result of the presence of said rolled lower edge in said space.

* * * * *